United States Patent [19]

Böcker

[11] Patent Number: 4,546,854

[45] Date of Patent: Oct. 15, 1985

[54] LOAD-CARRYING PLATFORM

[75] Inventor: Albert Böcker, Werne, Fed. Rep. of Germany

[73] Assignee: Albert Böcker GmbH & Co. KG, Fed. Rep. of Germany

[21] Appl. No.: 503,289

[22] Filed: Jun. 10, 1983

[30] Foreign Application Priority Data

Jun. 16, 1982 [DE] Fed. Rep. of Germany ..... 3222509

[51] Int. Cl.[4] ..... E06C 7/12; B66B 9/00

[52] U.S. Cl. ..... 182/103; 187/10

[58] Field of Search ..... 182/142, 103, 141; 187/10; 312/330 R, 341 R, 333; 308/3.8, 3.6

[56] References Cited

U.S. PATENT DOCUMENTS

| | | | |
|---|---|---|---|
| 2,787,278 | 4/1957 | Mitchell | 187/10 |
| 2,926,048 | 2/1960 | Gussack | 308/3.8 |
| 3,344,885 | 10/1967 | Rasmussen | 182/103 |
| 3,478,904 | 11/1969 | Courter | 187/10 |
| 3,848,937 | 11/1974 | Harder | 312/341 R |
| 3,891,067 | 6/1975 | Geneste | 182/103 |
| 4,121,876 | 10/1978 | Ratti | 312/330 R |

FOREIGN PATENT DOCUMENTS

| | | | |
|---|---|---|---|
| 1965715 | 7/1970 | Fed. Rep. of Germany | 312/341 R |
| 20902 | 1/1981 | Fed. Rep. of Germany | 187/10 |
| 322579 | 8/1957 | Switzerland | 308/3.8 |

*Primary Examiner*—Reinaldo P. Machado
*Assistant Examiner*—Alvin Chin-Shue
*Attorney, Agent, or Firm*—George A. Evans

[57] ABSTRACT

The invention relates to a load-carrying platform, particularly for moving furniture or the like along an inclined elevator. The load-carrying platform is supported by a carriage which is movable along guide rails of the elevator. Telescopic guides are provided between the carriage and the base of the platform, so that the platform is displaceable in relation to the carriage. Thus, when the unloading position is reached, the platform can be moved, at least partially, through a window opening and into the interior of a house.

3 Claims, 4 Drawing Figures

LOAD-CARRYING PLATFORM

BACKGROUND TO THE INVENTION

This invention relates to a load-carrying platform for use with elevating apparatus, and in particular to a load-carrying platform for moving furniture and the like up an inclined elevator.

Known load-carrying platforms of this kind typically have a base and, optionally, side walls which delimit the base. They enable a very wide variety of materials to be moved from lower loading points to upper unloading points or vice versa. Such load-carrying platforms also enable the furniture to be moved directly into buildings through, for example, window openings, so that the use of stairways (which may be difficult to negotiate) and lifts (which may not be suitable for carrying larger items) can be avoided. The known equipment does, however, suffer from the disadvantage that, although the base of a load-carrying platform can be brought directly in line with a window opening, it is not possible, or it is very difficult, to bridge this window opening so as to reach the interior of the room.

The object of the present invention is to provide a load-carrying platform, particularly for moving furniture, which does not suffer from this disadvantage.

SUMMARY OF THE INVENTION

The present invention provides in apparatus for carrying loads, the apparatus comprising a platform supported by a carriage, the improvement comprising supporting the platform on the carriage by telescopic guide means, whereby the platform can be displaced relative to the carriage.

In such an apparatus, it is possible to load the platform, supported on the carriage, in a first position; then to move it on, for example, the guide rails of an inclined elevator; and, on completion of this movement, to move the platform horizontally relatively to the carriage. This enables the platform to be moved into a window opening of a building.

Preferably, the telescopic guide means comprises two telescopic guides. Advantageously, each telescopic guide has a first rail fixed underneath the platform, a second rail fixed above the carriage, and a third rail telescoped within the first and second rails. Conveniently, each third rail is provided with rollers which rollingly engage the associated first and second rails. Preferably, each of the rollers is rotatably mounted on a bearing fixed to the associated third rail.

In a preferred embodiment, each first rail has a main section provided at opposite ends thereof with oppositely-directed flanges which extend at right-angles to said main section, each second rail has a main section provided at oppposite ends thereof with flanges which extend in the same direction at right-angles to said main section, and each third rail is a box-shaped cross-section, and wherein one of the flanges of each first rail extends into the respective box-shaped rail through a slot extending along said third rail. The other flange of each first rail may be fixed to the underneath of the platform. The rails may all be made of sheet metal.

Advantageously, each telescopic guide is provided with a locking bolt for locking the three rails of that telescopic guide together in a number of predetermined relative positions, the locking bolts passing through aligned apertures in the rails in said positions. In this case, the platform can be moved in the telescopic guides transversely with respect to the direction of movement of the carriage. Consequently, it is possible to move, for example, items of furniture through a window opening and into the interior of a building.

In a preferred arrangement, the load-carrying platform of the invention is associated with an inclined elevator, and preferably used for moving furniture. In this case, the platform can be supported in various angular positions on the carriage, which, in turn, is displaceably arranged on guide rails forming part of the inclined elevator. Accordingly, the invention also provides elevating apparatus comprising an inclined elevator, a wheeled carriage, and a platform supported by the carriage, the inclined elevator comprising a plurality of telescopic elevator sections and having a pair of guide rails along which the wheeled carriage can run, wherein the platform is supported on the carriage by telescopic guide means, whereby the platform can be displaced relative to the carriage.

Advantageously, the platform has a base and four upstanding side walls, each of the side walls being pivotally attached to the base. One of the side walls may be provided with a manually-grippable portion, which can be used to displace the platform relative to the carriage.

Preferably, at least one of the side walls is provided with a rail at its top edge, said rail being U-shaped and of tubular cross-section. These rails serve as bars which can be gripped by the operating personnel. They can also be used to enable fixing straps to be secured to the side walls.

BRIEF DESCRIPTION OF THE DRAWINGS

A load-carrying platform constructed in accordance with the invention will now be described, by way of example, with reference to the accompanying drawings, in which.

DESCRIPTION OF PREFERRED EMBODIMENT

Figure 1:
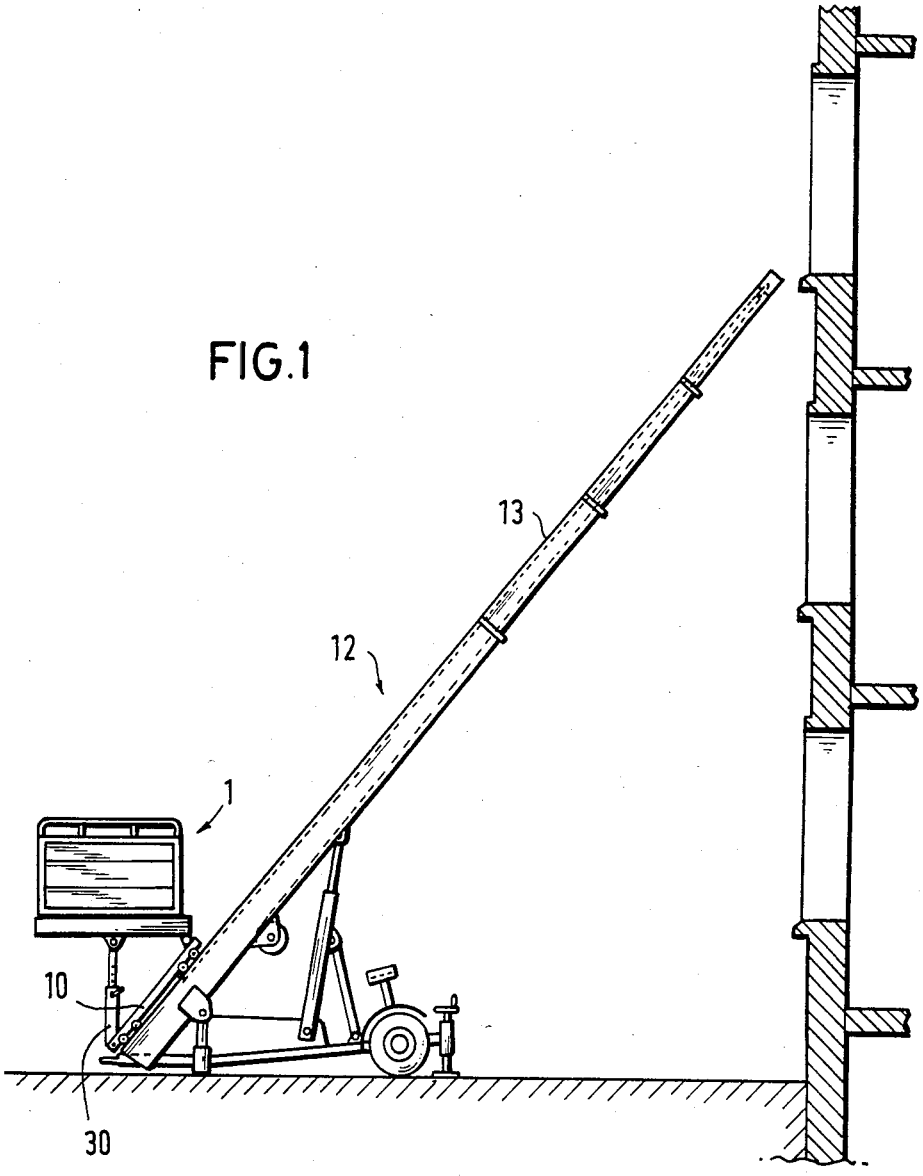
FIG. 1 is a side elevation of the platform positioned on an inclined elevator, the platform being shown at the bottom of the inclined elevator.

Referring to the drawings, FIG. 1 shows a loadcarrying platform 1 positioned at the bottom of an inclined elevator 12. The elevator 12 is constituted by a plurality of telescopic sections, and includes a pair of guide rails 13. The platform 1 is supported by a carriage 10, which is movable along the guide rails 13 by known means (not shown). The carriage 10 supports the platform 1 by means of brackets 29 and telescopic extensible supports 30. The supports 30 can be locked in different extended positions, so that the platform 1 can be positioned substantially horizontal no matter how the elevator 12 is inclined.

The platform 1 has a base 2, side walls 3, 4 and 5 and an end barrier 6. The side walls 3, 4 and 5 are pivotally attached to the base 2 by means of hinges 26, and the end barrier 6 is pivotally attached to the base 2 by means of hinges 27. The upper portions of the side walls 3, 4 and 5 are connectible by means of detachable locking elements (not shown) so that they can be held upright. The upper edges of the side walls 3, 4 and 5 are provided with U-shaped rails 23. These rails 23 can be gripped by operating personnel, and also serve as connection points for securing holding straps (shown in dash-dot lines 28 in FIG. 3).

Figure 2:
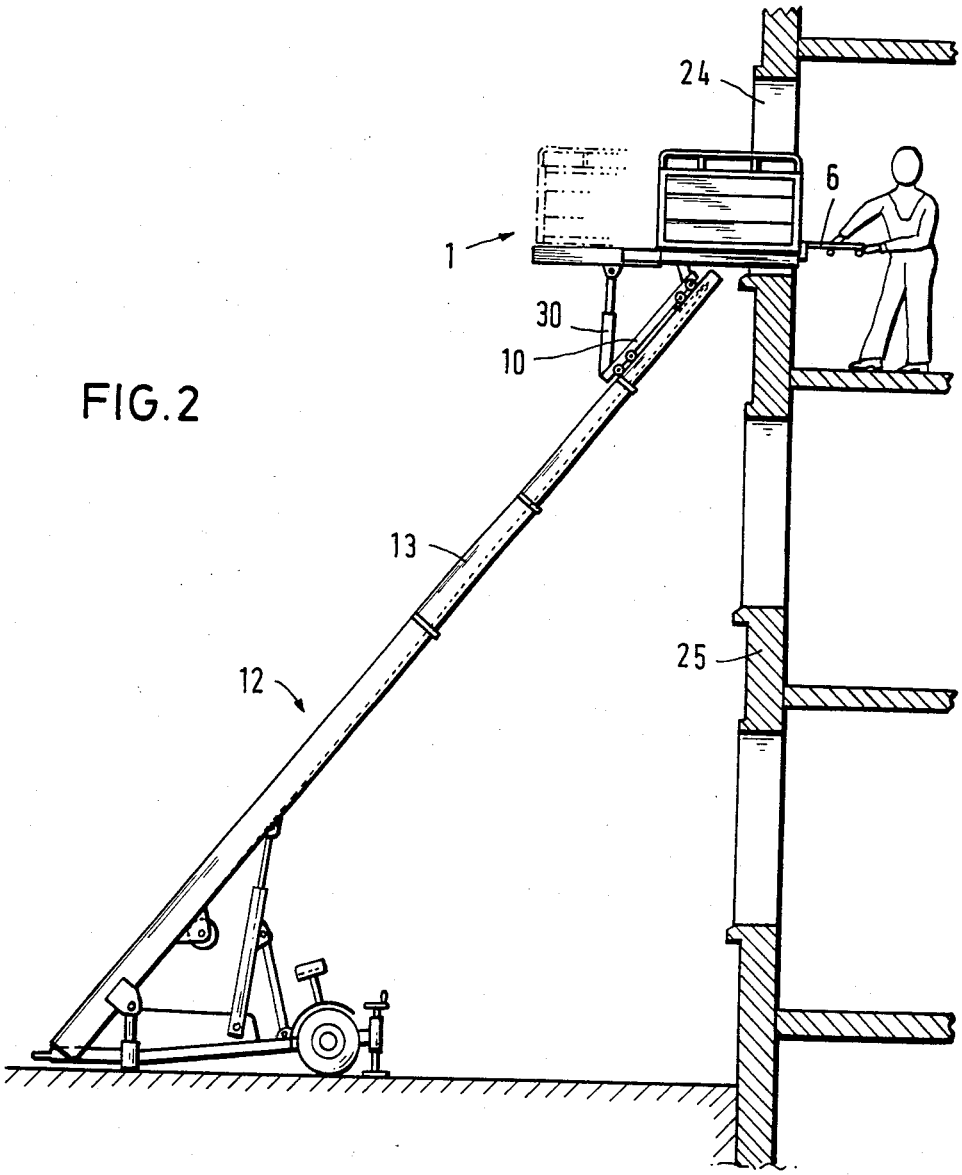
FIG. 2 is a side elevation similar to that of FIG. 1, but showing the platform at the top of the inclined elevator.
Figure 3:
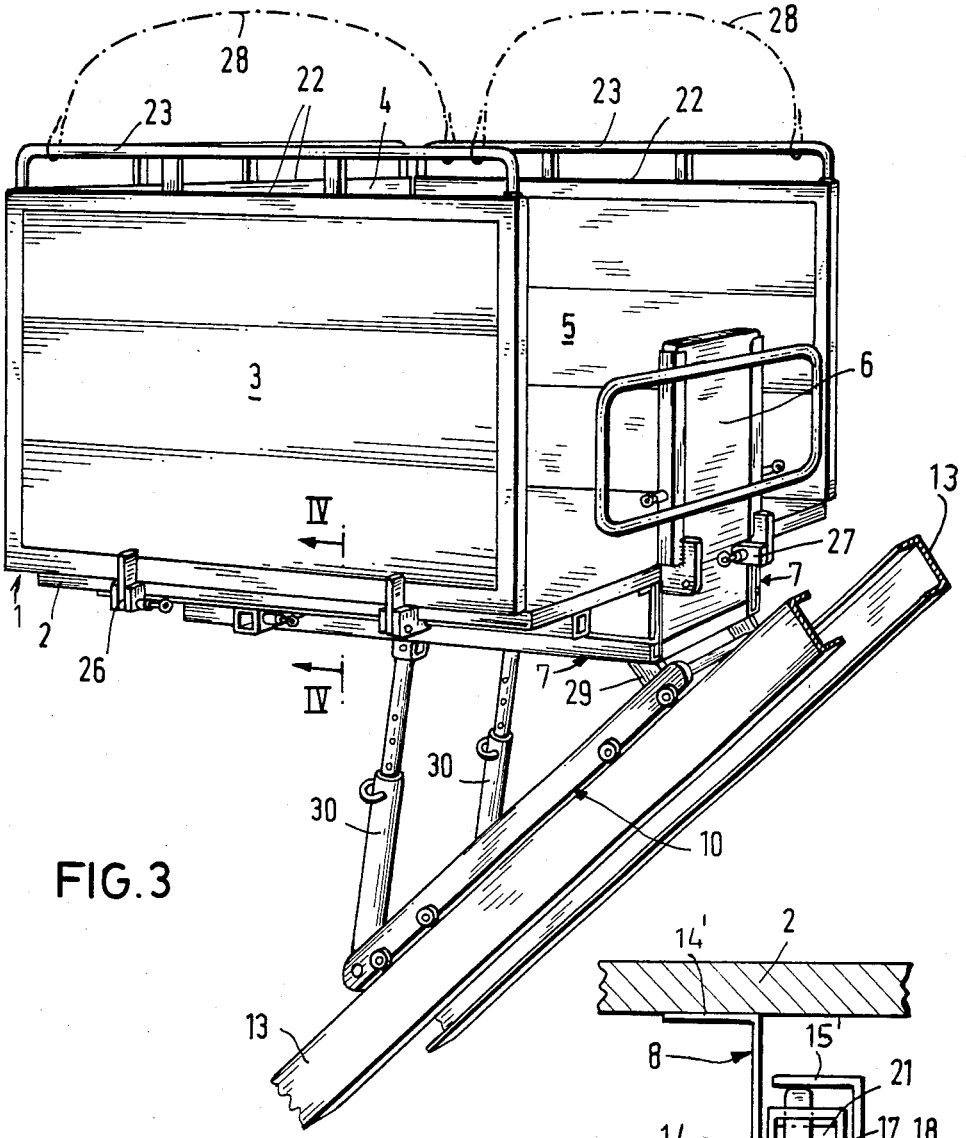
FIG. 3 is a perspective view of the platform.
Figure 4:
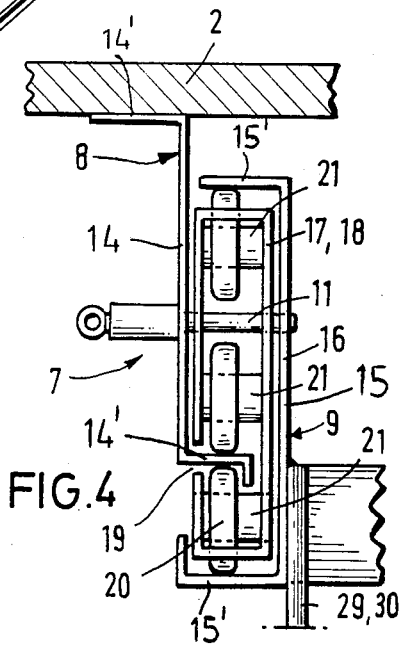
FIG. 4 is a cross-section taken on the line IV-IV of FIG. 3.

The platform 1 is supported on the carriage 10 by means of a pair of extensible telescopic guides 7 (see FIGS. 3 and 4). The guides 7 enable the platform 1 to be moved for example into a window opening 24 of a house 25 (see FIG. 2) when the platform is at the top of the elevator 12. In this position, the end barrier 6 is swung down, and used to pull the platform 1 along the guides 7. Each of the guides 7 has three rails 8, 9 and 17. Each of the rails 8 is fixed underneath the base 2 of the platform 1, and each of the rails 9 is fixed above the carriage 10 on a respective bracket 29 and on a respective telescopic support 30. Each of the rails 8 is made of angled sheet metal, and has horizontal flanges 14' extending in opposite directions from a vertical section 14. The upper flanges 14' are used to fix the rails 8 to the base 2. Each of the rails 9 is made of sheet metal, and has horizontal flanges 15' extending in the same direction from a vertical section 15. Each of the rails 17 is made of sheet metal and is of box-shaped cross-section. Each rail 17 carries bearings 21 for rollers 20, by means of which that rail 17 is telescopically supported within the associated fixed rails 8 and 9 (see FIG. 4). In this position, the lower flanges 14' of the fixed rails 8 extend into gaps 19 formed in the associated rails 17, and form tracks along which the middle rollers 20 can roll. The lower rollers 20 roll along tracks defined by the lower flanges 15' of the fixed rails 9, and the upper rollers 21 roll along tracks defined by the upper flanges 15' of the fixed rails 9. Each guide 7 is provided with a locking bolt 11, which can pass through aligned apertures (not shown) in the rails 8, 9 and 17 of that guide to lock the rails in one or more predetermined relative positions. For example, the apertures may be so positioned that the guides 7 can be locked in the fully retracted and fully extended positions. When not in use, each locking bolt is housed within a respective casing 31 fixed to the vertical section 14 of the associated rail 8, the bolts being spring biassed towards their locking positions, so that locking is automatic when the apertures come into alignment.

In use, the elevator 12 is positioned as shown in FIG. 1 with its telescopic sections extended sufficiently to reach the window opening 24. The guides 7 are then locked in the fully retracted position, with the carriage 10 and platform 1 at the bottom of the elevator 12 (see FIG. 1). The platform 1 is then loaded, one or more of the side walls 3, 4 and 5 being lowered during the loading if this is necessary. The carriage 10 is then moved up the elevator 12 until it is level with the window 24 (see FIG. 2). The locking bolts 11 are then released, the end barrier 6 is swung down, and the platform 1 is pulled into the window opening 24. The guides 7 are then locked using the belts 11, so that unloading can commence.

I claim:

1. In an inclined elevator having a plurality of telescopic elevator sections, each sections having guide rails, a carriage arranged to move thereon, a platform supported on the carriage, and guides for defining a path on the carriage over which the platform may travel, said guide comprising:

a first guide rail depending from each side of the platform, a second guide rail mounted above each side of the carriage disposed outside said first guide rails, said first rails each having a lower horizontal flange extending toward the adjourning second rail, said second rails each having upper and lower horizontal flanges extending inwardly, a third rail disposed between each set of first and second rails, said rails being of box-shaped cross section with vertical sides one of which is provided with a transverse slot, the horizontal flange of one of the guide rails extending into said slot, bearings extending between the vertical sides of each third rail, each bearing having a roller mounted thereon, said bearings serving to reinforce the sides of said third rail as well as to support said rollers, one of said bearing being disposed above said slot and another below said slot, the rollers on said bearings being arranged to roll on the tracks provided by the horizontal flange of the rail extending through said slot and the flange of the other rail disposed beneath the lower of said rollers, the horizontal flange on the rail extending into said slot having a down turned terminal flange arranged between the lower roller and the remote vertical side of the third rail and the lower horizontal flange of the second rail having an upturned terminal flange extending above the bottom of the third rail whereby lateral movement of the third rail between the first and second rails is restricted and said first and second rails are stiffened by the provision of such terminal flanges.

2. In an inclined elevator having a plurality of telescopic elevator sections, each section having guide rails, a carriage arranged to move thereon, a platform supported on the carriage, and guides for defining a path on the carriage over which the platform may travel, said guide comprising:

a first guide rail depending from each side of the platform, a second guide rail mounted above each side of the carriage disposed outside said first guide rails, said first rails each having a lower horizontal flange extending toward the adjoining second rail, said second rails each having upper and lower horizontal flanges extending inwardly, a third rail disposed between each set of first and second rails, said rail being of box-shaped cross section with vertical sides one of which is provided with a transverse slot, the horizontal flange of one of the guide rails extending into said slot, bearings extending between the vertical sides of each third rail, each bearing having a roller mounted thereon, said bearings serving to reinforce the sides of said third rail as well as to support said rollers, two of said bearing being disposed above said slot and another below said slot, the rollers on said bearings being arranged to roll on the tracks provided by the horizontal flange of the rail extending through said slot and the flange of the second rail disposed beneath the lowest of the aforesaid rollers, one of said rollers above the slot being disposed to engage the underside of the upper flange of the second rail to prevent vertical play between the second and third rails.

3. Apparatus as set forth in claim 2 including a locking bolt for locking the three rails of the telescopic guide together in a number of predetermined relative positions, the locking bolt passing through aligned apertures in the two sides of the third rail and the vertical portions of the first and second rails.

* * * * *